US005893611A

United States Patent [19]

Gamber

[11] Patent Number: 5,893,611

[45] Date of Patent: Apr. 13, 1999

[54] ROOFING REMOVAL APPARATUS

[76] Inventor: Elmo D. Gamber, 5220 Lisette, St. Louis, Mo. 63109

[21] Appl. No.: 08/892,556

[22] Filed: Jul. 14, 1997

[51] Int. Cl.[6] ..... B26B 3/08; E04D 15/02

[52] U.S. Cl. ..... 299/41.1; 15/236.1; 81/45

[58] Field of Search ..... 299/37.1, 39.1, 299/41.1; 30/169, 170; 15/236.1; 81/45

[56] References Cited

U.S. PATENT DOCUMENTS

| | | | |
|---|---|---|---|
| 4,860,450 | 8/1989 | Achille | 15/236.1 |
| 5,009,131 | 4/1991 | Alto et al. | 299/37.1 |
| 5,013,092 | 5/1991 | Kulhawy | 299/41.1 X |
| 5,076,119 | 12/1991 | Wenz | 81/45 |

*Primary Examiner*—David J. Bagnell

*Attorney, Agent, or Firm*—Michael S. Neustel

[57] ABSTRACT

A roofing removal apparatus for stripping shingles, roofing paper, tar paper and nails from roof decking prior to replacing and installing new shingles. The inventive device includes a frame having a pair of guide members with tapered ends, a motor having a drive shaft, a circular blade attached to the drive shaft for cutting nails and shingles, a handle adjustably attached to the frame, and a shield removably attached to the frame for enclosing a portion of the circular blade. The tapered ends of the frame project under the shingles while the circular blade simultaneously cuts the nails and shingles. The shingles are elevated along the tapered ends until they are completely removed from the roof decking. The circular blade ensures that all nails within the roof decking are cut flush to the surface of the roof decking.

9 Claims, 2 Drawing Sheets

ROOFING REMOVAL APPARATUS

BACKGROUND OF THE INVENTION

1. Field of the Invention

The present invention relates generally to roofing removal devices and more specifically it relates to a roofing removal apparatus for stripping shingles, roofing paper, tar paper and nails from roof decking prior to replacing and installing new shingles.

2. Description of the Prior Art

There are numerous roofing removal devices. For example, U.S. Pat. No. 4,269,450 to Welborn; U.S. Pat. No. 4,232,906 to Torbenson; U.S. Pat. No. 5,218,766 to Himebaugh; U.S. Pat. No. 4,880,491 to Jacobs et al.; U.S. Pat. No. 5,098,165 to Jacobs et al.; U.S. Pat. No. 4,477,972 to Testa, Jr.; U.S. Pat. No. 4,699,430 to Nichols; U.S. Pat. No. 4,691,439 to Marra; U.S. Pat. No. 4,086,699 to Olkkola; U.S. Pat. No. 4,756,578 to Mims et al.; U.S. Pat. No. 3,818,593 to Oliverius all are illustrative of such prior art.

Welborn (U.S. Pat. No. 4,269,450) discloses an electric motor, a self-propelled frame with the motor driving the frame forward and with front mounted rotary cutter heads disposed from a reversely turning, rotatably driven shaft for removing the shingles.

Torbenson (U.S. Pat. No. 4,232,906) discloses a frame having a handle, a pair of wheels, a motor, and cutter assemblies fixed to the axle having a coil spring portion connecting a cutter portion.

Himebaugh (U.S. Pat. No. 5,218,766) discloses an apparatus having a frame on which is mounted a vertically reciprocable blade having a leading edge adapted to be accommodated beneath a strip of roofing material. The reciprocal movement of the blade causes the roofing material overlying the leading edge to be freed from and lifted off the roof.

While these devices may be suitable for the particular purpose to which they address, they are not as suitable for stripping shingles, roofing paper, tar paper and nails from roof decking prior to replacing and installing new shingles. The prior art inventions are incapable of effectively removing all of the nails securing the shingles, therefore workers must either remove or the nails manually or drive them into the roof decking so as to not injure the new shingles. None of the prior art teaches an invention which utilizes a rotary blade for cutting various sizes of nails used to secure shingles to the roof decking. Further, none of the prior art teaches an invention which leaves a swaged surface free of nails upon the roof decking after removal of shingles.

In these respects, the roofing removal apparatus according to the present invention substantially departs from the conventional concepts and designs of the prior art, and in so doing provides an apparatus primarily developed for the purpose of stripping shingles, roofing paper, tar paper and nails from roof decking prior to replacing and installing new shingles.

SUMMARY OF THE INVENTION

A primary object of the present invention is to provide a roofing removal apparatus that will overcome the shortcomings of the prior art devices.

Another object is to provide a roofing removal apparatus that removes shingles, roofing paper, tar paper and nails from roof decking.

An additional object is to provide a roofing removal apparatus that leaves a swaged surface upon the roof decking free of nails.

A further object is to provide a roofing removal apparatus that is self standing.

Another object is to provide a roofing removal apparatus that requires nominal exertion by the user.

Another object is to provide a roofing removal apparatus that removes the shingles in large pieces instead of a plurality of small pieces for easy clean up.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
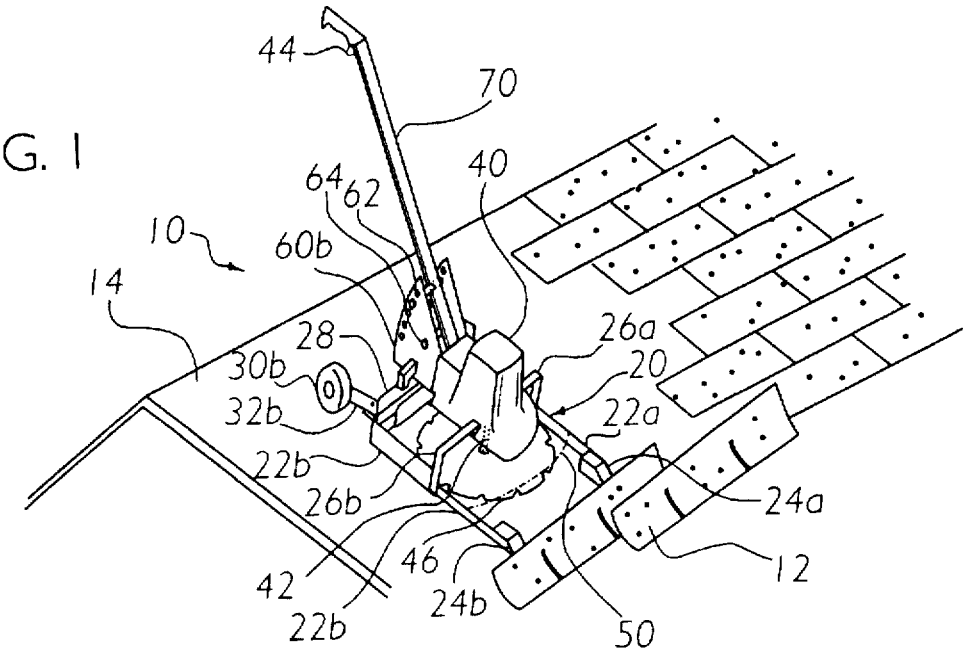
FIG. 1 is an upper perspective view of the present invention removing shingles.

Turning now descriptively to the drawings, in which similar reference characters denote similar elements throughout the several view, FIGS. 1 through 4 illustrate a roofing removal apparatus 10, which comprises a frame 20 having a pair of guide members 22*a–b* with tapered ends 24*a–b*, a motor 40 having a drive shaft 42, a circular blade 46 attached to the drive shaft 42 for cutting nails 16 and shingles 12, a handle 70 adjustably attached to the frame 20, and a shield 50 removably attached to the frame 20 for enclosing a portion of the circular blade 46. The tapered ends 24*a–b* of the frame 20 project under the shingles 12 while the circular blade 46 simultaneously cuts the nails 16 and shingles 12. The shingles 12 are elevated along the tapered ends 24*a–b* until they are completely removed from the roof decking 14. The circular blade 46 ensures that all nails 16 within the roof decking 14 are cut flush to the surface of the roof decking 14.

Figure 2:
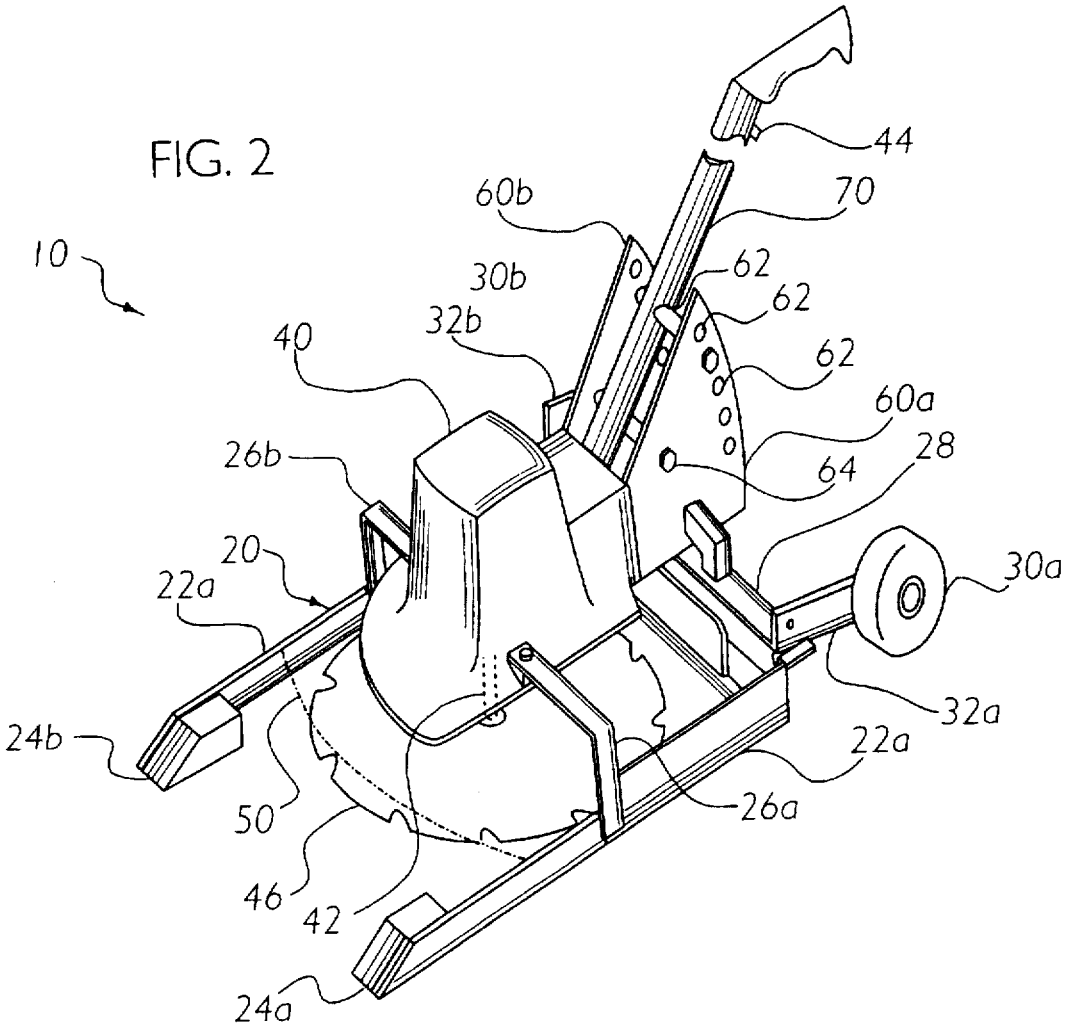
FIG. 2 is an upper perspective view of the present invention.
Figure 3:
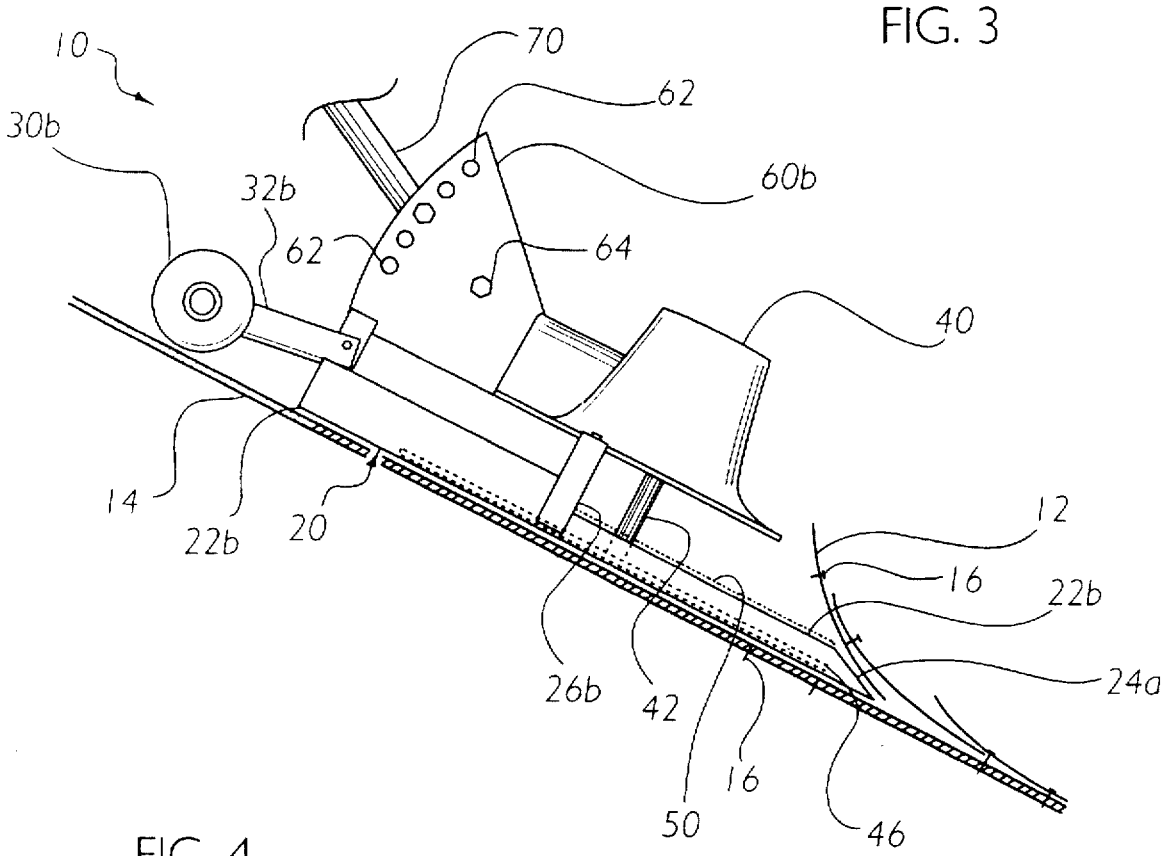
FIG. 3 is a side view of the present invention removing shingles.

As best shown in FIGS. 1 and 2 of the drawings, the frame 20 comprises a pair of guide members 22*a–b* distally spaced parallel to one another. The pair of guide members 22*a–b* have tapered ends 24*a–b* as best shown in FIG. 3 of the drawings. The tapered ends 24*a–b* project between the shingles 12 and the roof decking 14 as best shown in FIG. 3 of the drawings. As the frame 20 moves forward, the tapered ends 24*a–b* elevate the shingles 12 from the roof decking 14. The frame 20 further includes a cross member 28 secured between the pair of guide members 22*a–b* opposite of the tapered ends 24*a–b* as shown in FIG. 2 of the drawings.

Figure 4:
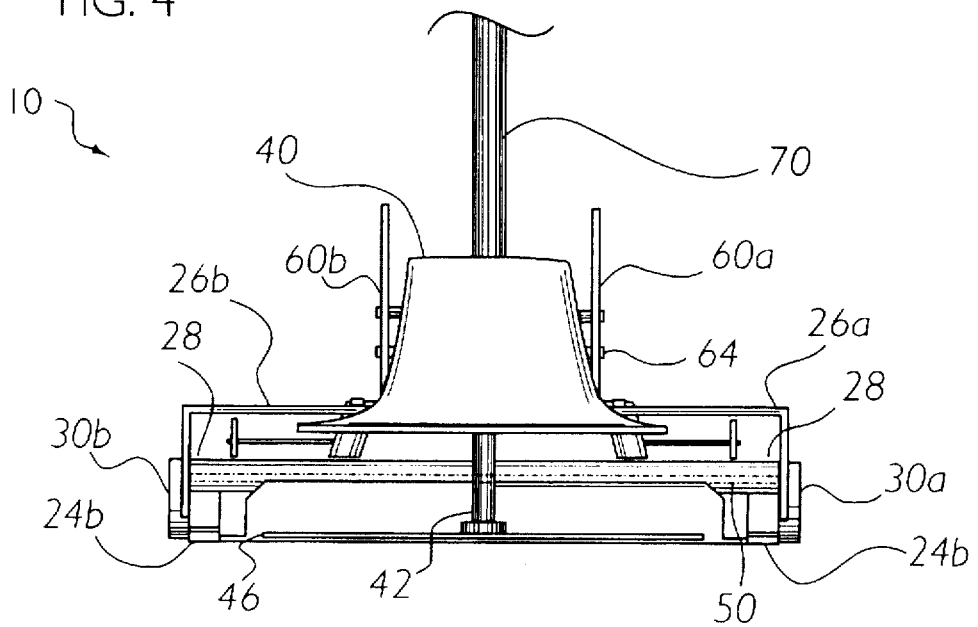
FIG. 4 is a front view of the present invention.

As shown in FIGS. 1, 2, 3 and 4 of the drawings, a motor 40 having a drive shaft 42 is attached centrally to the frame 20 by a pair of support members 26a–b secured to the pair of guide members 22a–b. The motor 40 preferably is an electric motor 40, but optionally could be gas powered. The drive shaft 42 is orthogonally positioned with respect to the pair of guide members 22a–b as best shown in FIG. 4 of the drawings. A circular blade 46 having a bottom surface and an upper surface is attached coaxially to the drive shaft 42 as best shown in FIG. 4 of the drawings. The drive shaft 42 attaches concentrically to an upper surface of the circular blade 46 to allow the bottom surface of the circular blade 46 to be flush with respect to the roof decking 14. The circular blade 46 preferably is constructed for cutting nails 16 such as the King Carbide Nail Cut Rescue blade 46 utilized by emergency crews.

As best shown in FIGS. 1 and 2 of the drawings, a protective shield 50 is removably attached to the frame 20 for preventing injury to the user from the circular blade 46. As shown in FIGS. 1 and 2 of the drawings, a pair of arms 32a–b are attached to the cross member 28 and extend away from the motor 40. A corresponding pair of wheels 30a–b are attached to the pair of arms 32a–b for allowing a user to elevate the circular blade 46 from a surface and for moving the invention while the circular blade 46 is rotating without engaging the surface.

As shown in FIGS. 1 through 3 of the drawings, a pair of side members 60a–b are attached to the cross member 28 and the motor 40. The pair of side members 60a–b have a plurality of apertures 62 distally spaced substantially vertically. A handle 70 having a first end and a second is provided, wherein the first end includes an aperture 62. A bolt 64 projects through the pair of side members 60a–b and handle 70 near the first end, wherein the handle 70 is pivotally attached. Another bolt 64 is removably projecting through the apertures 62 within the pair of side members 60a–b and through the aperture 62 within the handle 70 for locking the handle 70 in an angled position with respect to the frame 20. A switch 44 is attached near the second end of the handle 70, wherein the switch 44 is electrically connected to the motor 40 for allowing the user to control the operation of the motor 40.

In use, the user adjusts the angle of the handle 70 depending upon the angle of the roof decking 14 to be cleared. The user preferably positions the invention on an upper portion of the roof decking 14 to be cleared, where after the user closes the switch 44 for rotating the circular blade 46. The circular blade 46 is rotated by the motor 40. The user then manipulates the handle 70 attached to the frame 20 so as to position the tapered ends 24a–b of the guide members 22a–b between the shingles 12 and the roof decking 14. The user pushes the invention forward where after the circular blade 46 cuts the nails 16 securing the shingles 12 simultaneously while the tapered ends 24a–b elevate the shingles 12 from the roof decking 14. The bottom surface of the blade 46 preferably is juxtaposed to and parallel to the roof decking 14 as shown in FIG. 3 of the drawings. The user continuously manipulates the position of the invention for cutting the nails 16 and pushing the removed shingles 12 away from the roof decking 14. When the user has completely removed the shingles 12, the switch 44 is opened thereby terminating the rotation of the motor 40 and the circular blade 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roofing removal apparatus, comprising:

a frame having a front end and a rear end, said front end is tapered for projecting between said shingles and said roof decking;

a motor means attached to the frame;

a circular blade attached to said motor means for cutting nails securing said shingles to said roofing.

2. The roofing removal apparatus of claim 1, wherein at least one wheel is rotatably attached to said rear end of said frame for allowing manual movement of said frame.

3. The roofing removal apparatus of claim 2, wherein a handle is pivotally attached to said rear end of said frame.

4. The roofing removal apparatus of claim 3, wherein said handle is lockable into a desired position depending upon an angle of said roof decking.

5. The roofing removal apparatus of claim 4, wherein said frame comprises:

a pair of guide members distally spaced and parallel to one another;

said pair of guide members having a corresponding tapered end;

a cross member secured between said pair of guide members; and at least one support member attached to said pair of guide members and to said motor means for supporting said motor means.

6. A roofing removal apparatus, comprising:

a frame having a front end and a rear end, said front end is tapered for projecting between said shingles and said roof decking;

a handle pivotally attached to said frame for allowing a user to adjust an angle of said handle depending upon an angle of said roof decking;

a motor means attached to the frame;

a cutting means attached to said motor means for cutting nails securing said shingles to said roofing; and wherein said cutting means comprises a circular blade having an upper surface and a bottom surface, said bottom surface juxtposable to said roof decking.

7. The roofing removal apparatus of claim 6, wherein at least one wheel is rotatably attached to said rear end of said frame for allowing manual movement of said frame.

8. The roofing removal apparatus of claim 7, wherein:

a pair of side members are attached to said rear end of said frame distally spaced to one another, and said side members include a plurality of apertures substantially vertically orientated for receiving a bolt projecting through an aperture within said handle for locking said handle at a desired angle.

9. The roofing removal apparatus of claim 8, wherein said frame comprises:

a pair of guide members distally spaced and parallel to one another;

said pair of guide members having a corresponding tapered end;

a cross member secured between said pair of guide members; and at least one support member attached to said pair of guide members and to said motor means for supporting said motor means.

* * * * *